US006513625B1

(12) United States Patent
Gaskins

(10) Patent No.: US 6,513,625 B1
(45) Date of Patent: Feb. 4, 2003

(54) LADDER SUPPORT DEVICE FOR ROOF

(76) Inventor: Bernard J. Gaskins, 9080 P Moonshine Hollow, Laurel, MD (US) 20723

( * ) Notice: Subject to any disclaimer, the term of this patent is extended or adjusted under 35 U.S.C. 154(b) by 0 days.

(21) Appl. No.: 09/802,575

(22) Filed: Mar. 9, 2001

(51) Int. Cl.[7] ..... E06C 7/48
(52) U.S. Cl. ..... 182/45; 182/107; 182/206
(58) Field of Search ..... 182/107, 45, 206, 182/129

(56) References Cited

U.S. PATENT DOCUMENTS

| | | | | |
|---|---|---|---|---|
| 1,007,347 A | | 10/1911 | Flightner | |
| 1,393,048 A | * | 10/1921 | Stiles | 182/206 |
| 2,272,642 A | * | 2/1942 | Owens | 182/214 |
| 2,708,543 A | * | 5/1955 | Matich | 182/85 |
| 4,179,011 A | | 12/1979 | Morawski | |
| 4,678,061 A | | 7/1987 | Jordan et al. | |
| 4,787,478 A | | 11/1988 | Stakes | |
| 4,880,200 A | | 11/1989 | Champagne et al. | |
| 5,139,108 A | * | 8/1992 | Pate | 182/214 |
| D332,667 S | | 1/1993 | Brooks | |
| 5,497,848 A | * | 3/1996 | Travis | 182/107 |
| 5,875,867 A | * | 3/1999 | Beard | 182/45 |

FOREIGN PATENT DOCUMENTS

| | | | | |
|---|---|---|---|---|
| AT | 180713 | * | 6/1954 | 182/45 |
| DE | 3535409 | * | 3/1987 | 182/45 |
| GB | 182345 | * | 7/1922 | 182/206 |
| GB | 1355085 | * | 5/1974 | 182/206 |
| GB | 1538220 | * | 1/1979 | 182/206 |

* cited by examiner

*Primary Examiner*—Alvin Chin-Shue

(57) ABSTRACT

A ladder support device for a roof for holding a ladder on a roof. The ladder support device for a roof includes a first plate and a second plate. The first plate has a bottom edge, a top edge and a pair of side edges. The second plate has a bottom edge, a top edge and a pair of side edges. The top edges of the first and second plates are attached to each other along their lengths such that the plates are in an angular relationship with respect to each other. The plates have a top surface and a bottom surface. A bracket is coupled to the bottom edge of the first plate for removably engaging a top rung of the ladder. A block member is attached to the bottom surface of the first plate. The block member is positioned adjacent to and extends along the width of the second plate. The plates are placed on opposite sides of a roof to hold the ladder on the roof.

14 Claims, 3 Drawing Sheets

LADDER SUPPORT DEVICE FOR ROOF

BACKGROUND OF THE INVENTION

1. Field of the Invention

The present invention relates to ladder support devices and more particularly pertains to a new ladder support device for a roof for holding a ladder on a roof.

2. Description of the Prior Art

The use of ladder support devices is known in the prior art. More specifically, ladder support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,678,061; U.S. Pat. No. 4,179,011; U.S. Pat. No. 4,787,478; U.S. Pat. No. 4,880,200; U.S. Pat. No. 1,007,347; and U.S. Des. Pat. No. 332,667.

While these devices fulfill their respective, particular objectives and requirements, the aforementioned patents do not disclose a new ladder support device for a roof. The inventive device includes a first plate and a second plate. The first plate has a bottom edge, a top edge and a pair of side edges. The second plate has a bottom edge, a top edge and a pair of side edges. The top edges of the first and second plates are attached to each other along their lengths such that the plates are in an angular relationship with respect to each other. The plates have a top surface and a bottom surface. A bracket is coupled to the bottom edge of the first plate for removably engaging a top rung of the ladder. A block member is attached to the bottom surface of the first plate. The block member is positioned adjacent to and extends along the width of the second plate. The plates are placed on opposite sides of a roof to hold the ladder on the roof.

In these respects, the ladder support device for a roof according to the present invention substantially departs from the conventional concepts and designs of the prior art, and in so doing provides an apparatus primarily developed for the purpose of holding a ladder on a roof.

SUMMARY OF THE INVENTION

In view of the foregoing disadvantages inherent in the known types of ladder support devices now present in the prior art, the present invention provides a new ladder support device for a roof construction wherein the same can be utilized for holding a ladder on a roof.

The general purpose of the present invention, which will be described subsequently in greater detail, is to provide a new ladder support device for a roof apparatus and method which has many of the advantages of the ladder support devices mentioned heretofore and many novel features that result in a new ladder support device for a roof which is not anticipated, rendered obvious. suggested, or even implied by any of the prior art ladder support devices, either alone or in any combination thereof.

To attain this, the present invention generally comprises a first plate and a second plate. The first plate has a bottom edge, a top edge and a pair of side edges. The second plate has a bottom edge, a top edge and a pair of side edges. The top edges of the first and second plates are attached to each other along their lengths such that the plates are in an angular relationship with respect to each other. The plates have a top surface and a bottom surface. A bracket is coupled to the bottom edge of the first plate for removably engaging a top rung of the ladder. A block member is attached to the bottom surface of the first plate. The block member is positioned adjacent to and extends along the width of the second plate. The plates are placed on opposite sides of a roof to hold the ladder on the roof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder support device for a roof apparatus and method which has many of the advantages of the ladder support devices mentioned heretofore and many novel features that result in a new ladder support device for a roof which is not anticipated, rendered obvious, suggested, or even implied by any of the prior art ladder support devices, either alone or in any combination thereof.

It is another object of the present invention to provide a new ladder support device for a roof which may be easily and efficiently manufactured and marketed.

It is a further object of the present invention to provide a new ladder support device for a roof which is of a durable and reliable construction.

An even further object of the present invention is to provide a new, ladder support device for a roof which is susceptible of a low cost to manufacture with regard to both materials and labor, and which accordingly is then susceptible of low prices of sale to the consuming public, thereby making such ladder support device for a roof economically available to the buying public.

Still yet another object of the present invention is to provide a new ladder support device for a roof which provides in the apparatuses and methods of the prior art some of the advantages thereof, while simultaneously overcoming some of the disadvantages normally associated therewith.

Still another object of the present invention is to provide a new ladder support device for a roof for holding a ladder on a roof.

Yet another object of the present invention is to provide a new ladder support device for a roof which includes a first plate and a second plate. The first plate has a bottom edge, a top edge and a pair of side edges. The second plate has a bottom edge, a top edge and a pair of side edges. The top edges of the first and second plates are attached to each other along their lengths such that the plates are in an angular relationship with respect to each other. The plates have a top surface and a bottom surface. A bracket is coupled to the bottom edge of the first plate for removably engaging a top rung of the ladder. A block member is attached to the bottom surface of the first plate. The block member is positioned adjacent to and extends along the width of the second plate. The plates are placed on opposite sides of a roof to hold the ladder on the roof.

Still yet another object of the present invention is to provide a new ladder support device for a roof that may be used with existing ladders.

Even still another object of the present invention is to provide a new ladder support device for a roof that has a pole for lifting the device onto a roof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
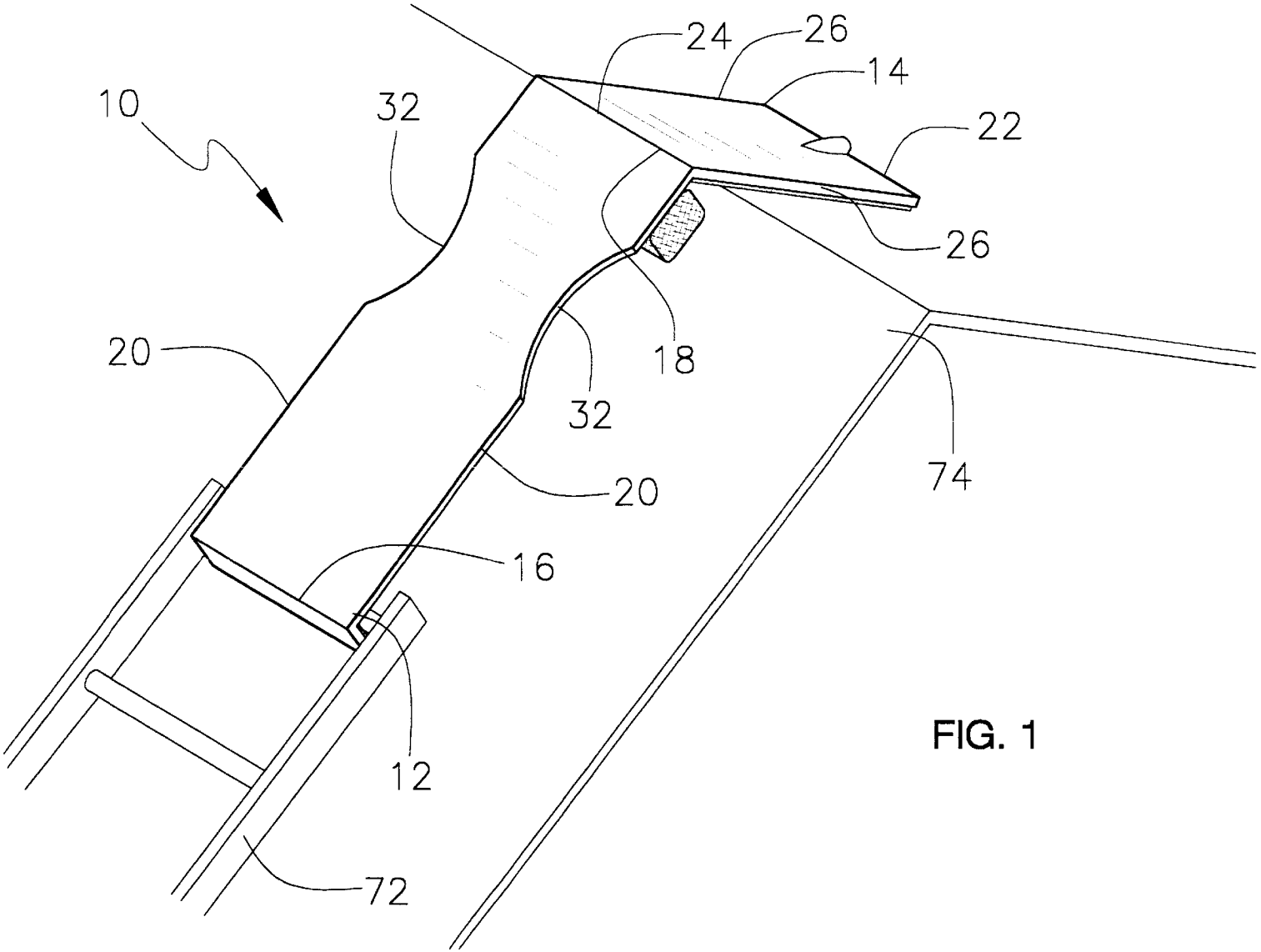
FIG. 1 is a schematic perspective view of a new ladder support device for a roof according to the present invention.
Figure 2:
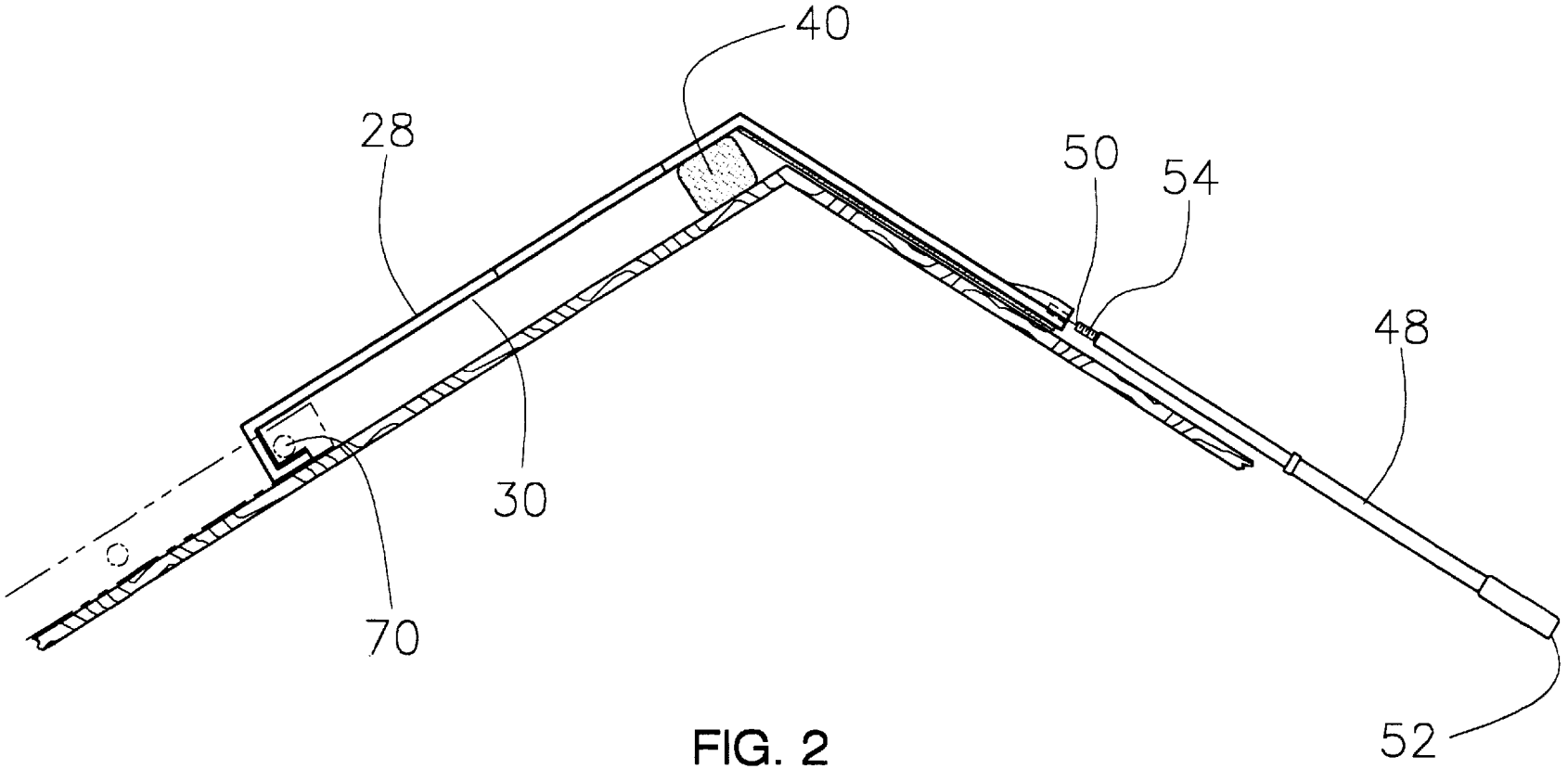
FIG. 2 is a schematic side view of the present invention.
Figure 3:
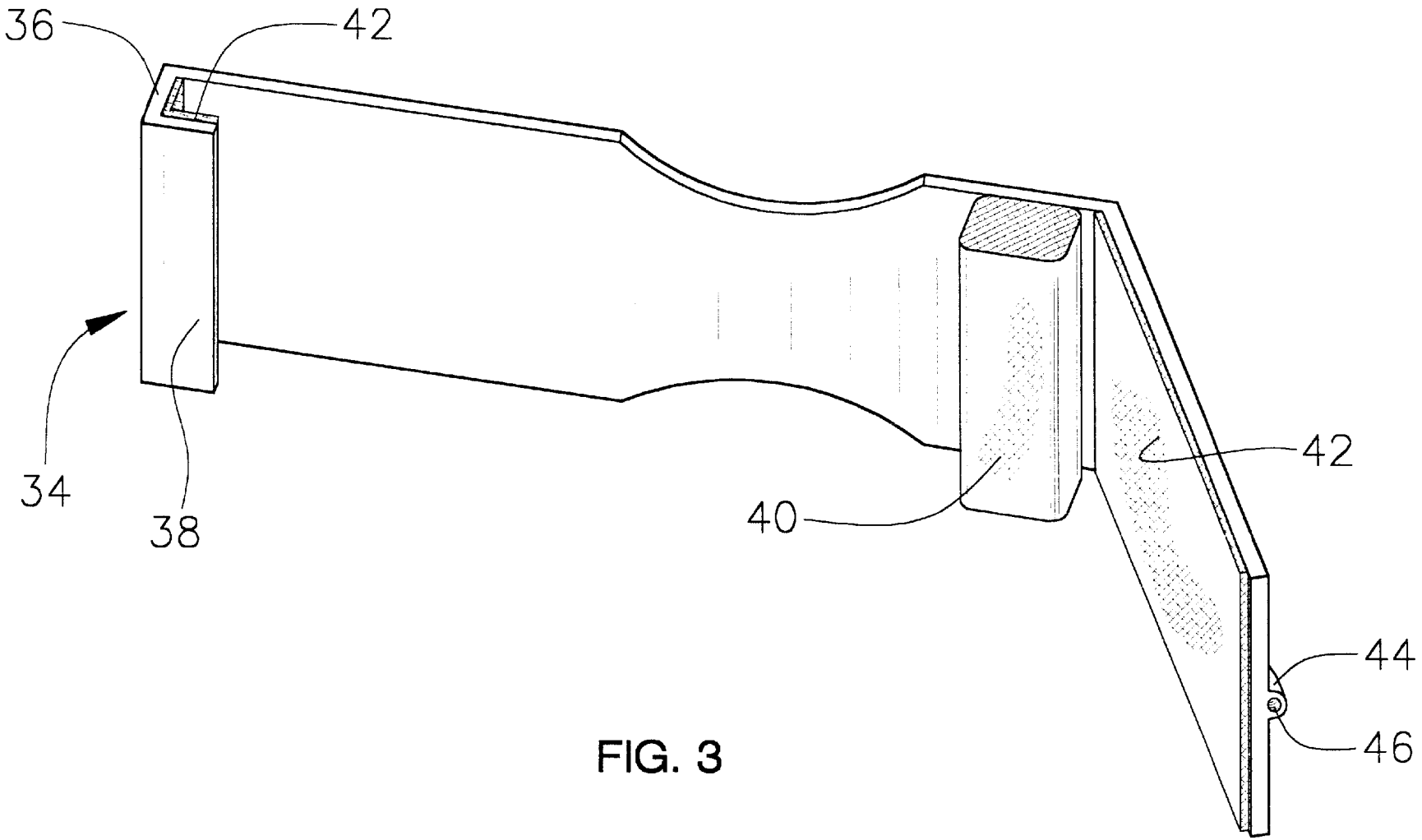
FIG. 3 is a schematic bottom perspective view of the present invention.

With reference now to the drawings, and in particular to FIGS. 1 through 3 thereof, a new ladder support device for a roof embodying the principles and concepts of the present invention and generally designated by the reference numeral 10 will be described.

As best illustrated in FIGS. 1 through 3, the ladder support device 10 generally comprises a first plate 12 and a second plate 14. The first plate 12 has a bottom edge 16, a top edge 18 and a pair of side edges 20. The second plate 14 has a bottom edge 22, a top edge 24 and a pair of side edges 26. The top edges 18, 24 of the first 12 and second 14 plates are attached to each other along their lengths such that the plates 12, 14 are in an angular relationship preferably between 90 degrees and 135 degrees with respect to each other. The plates 12, 14 have a top surface 28 and a bottom surface 30. The first plate 12 has a length extending between the top 18 and bottom 16 edges generally between 3 feet and 5 feet. The second plate 14 has a length extending between the top 24 and bottom 22 edges generally between 2 feet and 4 feet. The first 12 and second 14 plates each have a width between the side edges 20, 26 generally between 12 inches and 18 inches. Each of the side edges 20 of the first plate 12 has an arcuate groove 32 therein. The plates 12, 14 are rigid and preferably comprise a plastic material.

A bracket 34 is coupled to the bottom edge 16 of the first plate 12. The bracket 34 has an arm portion 36 and a hand portion 38 coupled together at a perpendicular orientation to each other. The arm portion 36 is coupled to and extends along the bottom edge 16 of the first plate 12 and is orientated perpendicular to the first plate 12 such that the hand portion 38 is spaced from and positioned below the first plate. The bracket 34 is positioned around a first rung 70 of a ladder 72 such that the first rung 70 is positioned between the first plate 12 and the hand portion 38. The arm portion 36 has a height generally between 3 inches and 4 inches.

A block member 40 is attached to the bottom surface 30 of the first plate 12. The block member 40 is positioned adjacent to and extends along the width of the second plate 14. The block member 40 extends away from the first plate 12 a distance substantially equal to a height of the arm portion 36. The block member 40 comprises a resiliently flexible material.

An elastomeric coating 42 is attached to and generally coats the bottom surface 30 of the second plate 14 and an inner surface of the bracket 36 directed toward bottom surface 30 of the first plate 12.

A nodule 44 is coupled to the top surface 28 of the second plate 14 and is positioned generally adjacent to the bottom edge 22 of the second plate 14. The nodule 44 has a forward side positioned adjacent to the bottom edge 22 of the second plate. The forward side has a threaded bore 46 therein. A pole 48 is elongated and has a first end 50 and a second end 52. An outer surface 54 of the pole adjacent to the first end 50 of the pole 48 is threaded. The first end 50 of the pole 48 may be extended into and threadably engaged to the threaded bore 46.

In use, the pole 48 is inserted into the nodule 44 and the pole 48 used to lift the device on the roof 74 of a dwelling. The bracket 34 is positioned around the top rung 70 of a ladder 72 with the second plate 14 abutted against the roof 74 as shown in FIG. 1. The block member 40 spaces the first plate 12 away from the roof 74 and the elastomeric coating 42 protects the roof 74 and helps to make the device non-slip.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder holding device for removably coupling to the top rung of a ladder and being positioned on a roof for holding the ladder on the roof, said device comprising:

a first plate and a second plate, said first plate having a bottom edge, a top edge and a pair of side edges, said second plate having a bottom edge, a top edge and a pair of side edges, said top edges of said first and second plates being attached to each other along their lengths at a juncture such that said plates are in an annular relationship with respect to each other, said plates having a top surface and a bottom surface;

a bracket being coupled to said bottom edge of said first plate for removably engaging said top rung of said ladder, said bracket having an arm portion and a hand portion coupled together at a perpendicular orientation to each other, said arm portion being coupled to and extending along said bottom edge of said first plate and being oriented substantially perpendicular to said first plate such that said band portion is spaced from and positioned below said first plate, said bracket being positionable around the top rung such that the top rung is positioned between said first plate and said hand portion;

a block member being attached to said bottom surface of said first plate such that when the juncture of said first and second plates is positioned over an apex of the roof, said block member will abut the roof, said block member extending away from said first plate a distance substantially equal to a height of said arm portion, said block member being positioned adjacent to and extending along the width of said second plate;

a nodule being coupled to a top surface of said second plate and positioned generally adjacent to said bottom edge of said second plate, said nodule having a forward side being positioned adjacent to said bottom edge of said second plate, said forward side having a threaded bore therein; and a pole being elongated and having a first end and a second end, an outer surface of said pole adjacent to said first end being threaded, said first end of said pole may be extended into and threadably engaged to said threaded bore.

2. The ladder holding device as in claim 1, wherein said angular relationship is generally between 90 degrees and 135 degrees.

3. The ladder holding device as in claim 1, wherein said first plate has a length extending between said top and bottom edges generally between 3 feet and 5 feet, said second plate having a length extending between said top and bottom edges generally between 2 feet and 4 feet.

4. The ladder holding device as in claim 2, wherein said first and second plates each have a width between said side edges generally between 12 inches and 18 inches.

5. The ladder holding device as in claim 1, wherein said first and second plates each have a width between said side edges generally between 12 inches and 18 inches.

6. The ladder holding device as in claim 1, further including an elastomneric coating being attached to and generally coating said bottom surface of said second plate and an inner surface of said bracket directed toward bottom surface of said first plate.

7. A ladder holding device for removably coupling to the top rung of a ladder and being positioned on a roof for holding the ladder on the root. said device comprising:

a first plate and a second plate, said first plate having a bottom edge, a top edge and a pair of side edges, said second plate having a bottom edge, a top edge and a pair of side edges, said top edges of said first and second plates being attached to each other along their lengths such that said plates are in an angular relationship generally between 90 degrees and 135 degrees with respect to each other, said plates having a top surface and a bottom surface, said first plate having a length extending between said top and bottom edges generally between 3 feet and 5 feet, said second plate having a length extending between said top and bottom edges generally between 2 feet and 4 feet, said first and second plates each having a width between said side edges generally between 12 inches and 18 inches;

a bracket being coupled to said bottom edge of said first plate, said bracket having an arm portion and a hand portion coupled together at a perpendicular orientation to each other, said arm portion being coupled to and extending along said bottom edge of said first plate and orientated perpendicular to said first plate such that said hand portion is spaced from and positioned below said first plate, wherein said bracket is positioned around said first rung such that said first rung is positioned between said first plate and said hand portion, said arm portion having a height generally between 3 inches and 4 inches;

a block member being attached to said bottom surface of said first plate, said block member being positioned adjacent to and extending along the width of said second plate, said block member extending away from said first plate a distance substantially equal to a height of said arm portion, said block member comprising a resiliently flexible material;

an elastomeric coating being attached to and generally coating said bottom surface of said second plate and an inner surface of said bracket directed toward bottom surface of said first plate;

a nodule being coupled to a top surface of said second plate and positioned generally adjacent to said bottom edge of said second plate, said nodule having a forward side being positioned adjacent to said bottom edge of said second plate, said forward side having a threaded bore therein; and a pole being elongated and having a first end and a second end, an outer surface of said pole adjacent to said first end threaded, said first end of said pole may be extended into and threadably engaged to said threaded bore.

8. A ladder holding device for removably coupling to the top rung of a ladder and being positioned on a roof for holding the ladder on the roof, said device comprising:

a first plate and a second plate, said first plate having a bottom edge, a top edge and a pair of side edges, said second plate having a bottom edge, a top edge and a pair of side edges, said top edges of said first and second plates being attached to each other along their lengths such that said plates are in an angular relationship with respect to each other, said plates having a top surface and a bottom surface;

a bracket being coupled to said bottom edge of said first plate for removably engaging said top rung of said ladder;

a nodule being coupled to a top surface of said second plate and positioned generally adjacent to said bottom edge of said second plate, said nodule having a forward side being positioned adjacent to said bottom edge of said second plate, said forward side having a threaded bore therein; and a pole being elongated and having a first end and a second end, an outer surface of said pole adjacent to said first end being threaded, said first end of said pole may be extended into and threadably engaged to said threaded bore.

9. The ladder holding device as in claim 8, further including a block member being attached to said bottom surface of said first plate, said block member being positioned adjacent to and extending along the width of said second plate.

10. The ladder holding device as in claimed 8, wherein said angular relationship is generally between 90 degrees and 135 degrees.

11. The ladder holding device as in claim 8, wherein said first plate has a length extending between said top and bottom edges generally between 3 feet and 5 feet, said second plate having a length extending between said top and bottom edges generally between 2 feet and 4 feet.

12. The ladder holding device as in claim 8, wherein said first and second plates each have a width between said side edges generally between 12 inches and 18 inches.

13. The ladder holding device as in claim 8, wherein said bracket has an arm portion and a hand portion coupled together at a perpendicular orientation to each other, said arm portion being coupled to and extending along said bottom edge of said first plate and orientated perpendicular to said first plate such that said hand portion is spaced from and positioned below said first plate, wherein said bracket is positioned around said first rung such that said first rung is positioned between said first plate and said hand portion.

14. The ladder holding device as in claim 13, further including an elastomeric coating being attached to and generally coating said bottom surface of said second plate and an inner surface of said bracket directed toward bottom surface of said first plate.

* * * * *